US005636561A

United States Patent [19]

Pecorari

[11] Patent Number: 5,636,561

[45] Date of Patent: Jun. 10, 1997

[54] VOLUMETRIC FLUID MACHINE EQUIPPED WITH PISTONS WITHOUT CONNECTING RODS

[76] Inventor: Felice Pecorari, Via della Resistenza 3, Campogalliano, Italy, 41011

[21] Appl. No.: 424,304

[22] PCT Filed: Oct. 30, 1992

[86] PCT No.: PCT/IT92/00134

§ 371 Date: Apr. 26, 1995

§ 102(e) Date: Apr. 26, 1995

[87] PCT Pub. No.: WO94/10442

PCT Pub. Date: May 11, 1994

[51] Int. Cl.[6] ..... F01B 13/04; F01C 3/06; F02B 57/00

[52] U.S. Cl. ..... 91/499; 123/43 A; 123/43 B

[58] Field of Search ..... 123/43 R, 43 A, 123/43 B; 91/499, 504, 505

[56] References Cited

U.S. PATENT DOCUMENTS

| | | | |
|---|---|---|---|
| 953,868 | 4/1910 | Tcherepanoff | 123/43 B |
| 3,229,677 | 1/1966 | Hughes | 123/43 B |
| 3,333,577 | 8/1967 | Mongitore | 123/43 A |
| 3,648,567 | 3/1972 | Clark . | |
| 3,910,239 | 10/1975 | James . | |
| 4,138,930 | 2/1979 | Searle | 123/43 A |
| 4,363,294 | 12/1982 | Searle | 123/43 A |
| 4,487,168 | 12/1984 | Bajulaz | 123/43 R |

FOREIGN PATENT DOCUMENTS

| | | | |
|---|---|---|---|
| 1408719 | 7/1965 | France . | |
| 215838 | 11/1909 | Germany | 123/43 R |
| 1184555 | 12/1964 | Germany | 123/43 B |
| 1451810 | 6/1969 | Germany | 123/43 B |
| 3304117 | 8/1984 | Germany | 123/43 B |
| 632421 | 11/1949 | United Kingdom | 123/43 B |
| 2001704 | 2/1979 | United Kingdom | 123/43 B |
| 2027122 | 2/1980 | United Kingdom . | |
| 8600662 | 1/1986 | WIPO . | |

*Primary Examiner*—Michael Koczo
*Attorney, Agent, or Firm*—Lerner, David, Littenberg, Krumholz & Mentlik

[57] ABSTRACT

A machine is disclosed that may be configured as a pump, a compressor or an engine. The machine displaces volume by means of pistons that are connected to a driveshaft without oscillating connecting rods. Cylinders are disposed in a rotating cylinder block that rotates on an axis inclined to the axis of rotation of the pistons. A spherical member centers the driveshaft with respect to the cylinder block, and a biasing means urges the cylinder block against a bearing surface. Displacement may be varied by varying the angle of inclination of the two axes of rotation.

17 Claims, 5 Drawing Sheets

VOLUMETRIC FLUID MACHINE EQUIPPED WITH PISTONS WITHOUT CONNECTING RODS

BACKGROUND OF THE INVENTION

The invention relates to a pump, a compressor or an engine, which may be endothermic, that displaces volume by means of pistons connected to the driveshaft without oscillating connecting rods. The machine may have a variable displacement.

In the field of endothermic engines, there exist several configurations in use today: engines having reciprocating pistons connected to a crankshaft with connecting rods; volumetric lobe (Wankel) engines having a rotor eccentric to a driveshaft; and engines having axial pistons, i.e. pistons parallel to the driveshaft and driven in reciprocating motion with a circular inclined cam, such that the pistons are displaced axially. The latter arrangement does not yield high performance.

In the field of pumps/engines or fluid compressors, both for compressible and incompressible fluids, several piston arrangements are known: in-line pistons, pistons mounted axially, pistons with an oscillating barrel or an oscillating plate and radially mounted pistons.

In each of the above-mentioned piston arrangements, the pistons are connected to the driveshaft with connecting rods. In the case of radially mounted or in-line pistons, the connecting rods oscillate in a plane perpendicular to the driveshaft. In the case of axially mounted pistons, the connecting rods oscillate as they run on the conoid surface of the swashplate, because the point of contact between the crank end of the connecting rod and the swashplate varies with the inclination of the swashplate, while the piston end of the connecting rod remains at the center of the cylinder.

Each of the above-mentioned mechanisms, with the exception of the endothermic lobe (Wankel) engine, have large overall dimensions. Further, none have high efficiency, and the efficiency depends on the conditions of use.

In particular, for rotary lobe (Wankel) engines, the sealing parts have a short life because they are subjected to heavy wear. This results in a loss of compression and a resulting loss of efficiency. Special materials must be used that are very expensive and difficult to obtain.

Endothermic piston engines, in all their various configurations, have a limited speed of rotation due to the alternating or oscillating motion of the pistons, connecting rods, valves and crankshaft. The crankshaft is typically difficult to manufacture. Axial thrust from the piston is transmitted to the connecting rod at varying angles, causing a reaction with the cylinder wall; this reaction causes heavy wear, requiring the use of high performance lubricating oils. In four-stroke engines, efficiency is reduced because of the restricted passageway in the valves and because it is impossible to ideally design the combustion chamber due to various design considerations.

Regarding pumps for compressible fluids, those machines suffer the same disadvantages as those encountered for endothermic piston engines. Piston pumps for compressible fluids have low efficiency due to the mechanical friction of the connecting rods, in addition to high weight, large overall dimensions and high cost.

Pumps for incompressible fluids are typically used in hydrostatic transmissions and for the pumping of other liquids. Pumps having radial or inline cylinders, while providing fairly good performance, have large overall dimensions and high manufacturing costs. Incompressible fluid pumps having axial cylinders may be subdivided into the following two categories: pumps having cylinders arranged in a barrel inclined with respect to the axis of the shaft, and pumps have an inclined plate on the shaft for guiding pistons within cylinders that are parallel to the axis of the shaft. Both arrangements unacceptably limit the speed of rotation, because of centrifugation of the crank end of the connecting rods. In addition, the arrangement having cylinders parallel to the driveshaft has very low efficiency at low speeds and may not be used in an open hydraulic circuit. The acceptance of both arrangements in the market has been further limited by high manufacturing costs.

WO-A 86/00662 discloses a piston machine in which an assembly of cylinders is arranged equidistantly about a first axis of rotation, and an assembly of corresponding pistons is arranged equidistantly around a second axis of rotation. Each piston comprises a ring member that is displaceable laterally of the piston itself to enable the ring member to move substantially rectilinearly of the corresponding cylinder while the piston itself moves through a curved path relative thereto. The second axis passes through the intersection of the circular plane formed by the spherical ring members with the first axis. While this machine eliminates many parts associated with reciprocal motion, performance is adversely affected by periodic shocks of the ring member during operation. Performance is adversely affected by those vibrations, by friction caused by centrifugation and by the thrust of the ring members toward the cylinder walls.

U.S. Pat. No. 3,910,239 discloses a piston power unit primarily for use as an internal combustion engine. The machine has a single cylinder curved about a center, intake and exhaust ports at opposite ends of the cylinder, and a pair of opposed pistons movable in the cylinder towards and away from each other in compression and power strokes. The pistons cover the ports during most of the stroke, and successively open the ports as the pistons approach ends of their respective power strokes. A pair of connecting rods connect a pair of crankshafts, including intermeshing gears, to the pistons.

This piston engine presents problems in that the thrust of the pistons toward the cylinder wall and the centrifugal force on the pistons increase the friction of the piston on the outer cylinder wall, adversely affecting performance. The design is useful only for engines having asymmetric port timing, as clearly stated in the specification. The improvements to this machine disclosed in U.S. Pat. No. 3,338,137, by the same inventor, are for structural aspects of manufacturing only.

There is a long-felt need to improve the characteristics of the above-described reciprocating volumetric machines by increasing efficiency under all conditions and reducing weight, overall dimensions and manufacturing costs. From the above, technical problems would be solved in reciprocating volumetric machines by eliminating all parts have oscillating motion, which would improve performance, while at the same time reducing overall size and weight.

SUMMARY OF THE INVENTION

The present invention is directed to the desired improvements discussed above.

In one embodiment of the invention, a volumetric fluid machine, endothermic or not, is equipped with pistons having reciprocating movement in the cylinder block. The machine does not have connecting rods, and the pistons may be rigidly connected to the driveshaft. The pistons are mobile inside the cylinders, which may be machined in a rotating cylinder block on an axis that may coincide or intersect with the axis of the driveshaft. The pistons rotate with the cylinders, but on an inclined axis, coinciding with the axis of rotation of the cylinders, or passing through the same center. There are no interposing elements having reciprocating motion. The cylinders have an arched form concave toward the center, with the center of curvature of the cylinders coinciding with or passing through the same center. The pistons rotate synchronously with the cylinders, but on an inclined axis coinciding with the axis of rotation of the cylinders, or passing through the same center of curvature.

In a further embodiment, the angle between the axis of rotation of the cylinder block and the axis of rotation of the pistons may be varied in order to vary displacement.

In another embodiment, the pistons are connected rigidly to, or alternatively, permitted to oscillate on, a shaft or rotation plate, without the interposition of connecting rods.

In another embodiment, the pistons have spherical heads and piston rings having spherical faying surfaces. The piston rings are located in the piston head in such a way as to come into contact with the respective cylinder wall radially with respect to the axis of that cylinder.

In yet another embodiment, the pistons are arched in the same way as the cylinders and have piston rings with spherical faying surfaces.

In the case of an internal combustion engine, according to the invention, a distribution plate is placed adjacent to the cylinder block with at least one communication port to the cylinders for induction, at least one communication port for exhaust and at least one combustion chamber. The distribution plate may rotate with respect to the engine block or casing. Further, the distribution plate may have closed zones in intermediate positions that coincide with the end of the exhaust stroke and thus achieve null volume in four-stroke cycles.

In another embodiment of the invention, a single auxiliary cooling lubricating circuit is incorporated in the volumetric fluid machine. In that embodiment, the cylinder block may be the moving portion of the pump for the cooling and lubricating circuit.

In an embodiment of the volumetric machine for pumping fluids, the piston rotation plate or the cylinder block may be keyed or rigidly connected to the driveshaft. The pistons may be rigidly connected to a shank, which, in turn, is rigidly connected to the rotation plate, that may be inclinable or inclined. The pistons may be connected to the shank with a connecting bolt, such that they may oscillate on spherical and concentric surfaces on the shank and on the head of the connecting bolt. Further, the displacement of the fluid pump may be varied by varying the angle between the pistons and the cylinders. The angle is varied by rotating a plate having a cylindrical rear surface with an axis of rotation that passes through the intersection point of the axis of rotation of the cylinder block and the pistons.

In summary, the advantages of the present invention, for all types of volumetric machines for fluids, lie in the absence of alternating and oscillating parts such as connecting rods, traditional pistons and valves. Those improvements lead to a considerable reduction in noise, due to the absence of thrust elements that create noise during oscillation because of the unavoidable clearances between components.

The radial loading of the pistons against the walls of the cylinders is eliminated because the thrust of the fluid is tangential to the curvature of the cylinder, which coincides with the center of the spherical piston, whether fixed or oscillating. There is consequently a considerable reduction in wear and an increase in efficiency in the fluid pumps of the present invention, especially at start-up.

The volumetric machine of the present invention has fewer parts to be manufactured, and there is a considerable reduction in swarf machining. The axial and radial dimensions of the machines are considerably reduced, resulting in higher power and better efficiency.

With respect to internal combustion engines, centrifugation or elasticity that can limit rotation speed are eliminated. Cooling of the pistons from the internal part of the housing is facilitated, as is cooling of the rotating cylinder block, which can easily operate as a pump for cooling liquid. The inherent resistance and choking of the valves are eliminated. The lubrication and cooling circuits are not separate, as it is possible to utilize the cooling liquid in the lubrication function as well.

Furthermore, particularly for volumetric pumps or compressors, the compensation of axial thrust on the pistons is facilitated, such compensation further reducing friction and increasing efficiency. Connecting members between the pistonholder plate and the cylinder block are not required, as they are in barrel pumps or engines. In the embodiment having pistons with fixed spherical heads connected to the piston holder, low to medium angles between the driveshaft and the inclined element (either the pistons or the cylinder block) are possible, and the machine may run at high speeds because there are no components subject to centrifugation. In the embodiment having pistons with oscillating heads, very large angles of inclination are possible, and the overall dimensions of the machine may be reduced even with large displacements. Self-centering piston heads that align on the tangent of the line of curvature at any point along the cylinder, do not radially load the cylinder wall, limiting wear and increasing efficiency.

Finally, the present invention as embodied in a pump in a hydraulic circuit can function in both open circuits and closed circuits at the same speed of rotation, as there are no articulating components such as connecting rods that could disconnect and centrifugate. A closed hydraulic circuit may be fed directly using a pump of the invention, without the traditional use of so-called "charge pumps." More than one pump may easily be combined on a single shaft for use in different hydraulic circuits, with reduced dimensions. Each of the combined pumps can be sized and/or adjusted for the particular requirements of the circuit, avoiding the use of expensive mechanical couplings.

DETAILED DESCRIPTION OF THE PREFERRED EMBODIMENT

Figure 2:
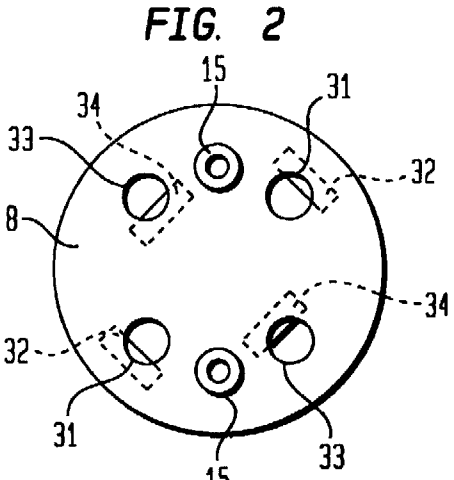
FIG. 2 is a plan view of a distribution plate, from the side facing the cylinder block, of the engine shown in FIG. 1.
Figure 3:
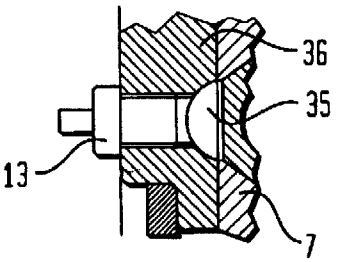
FIG. 3 is a partial sectional view of an ignition device of a two-stroke engine of the invention.
Figure 5:
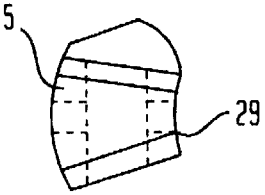
FIG. 5 is a side elevational view of the piston of FIG. 4 rotated ninety degrees.
Figure 4:
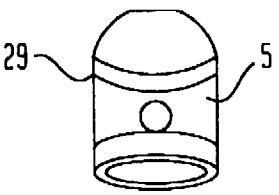
FIG. 4 is a side elevational view of a curved piston of the engine of FIG. 1.
Figure 1:
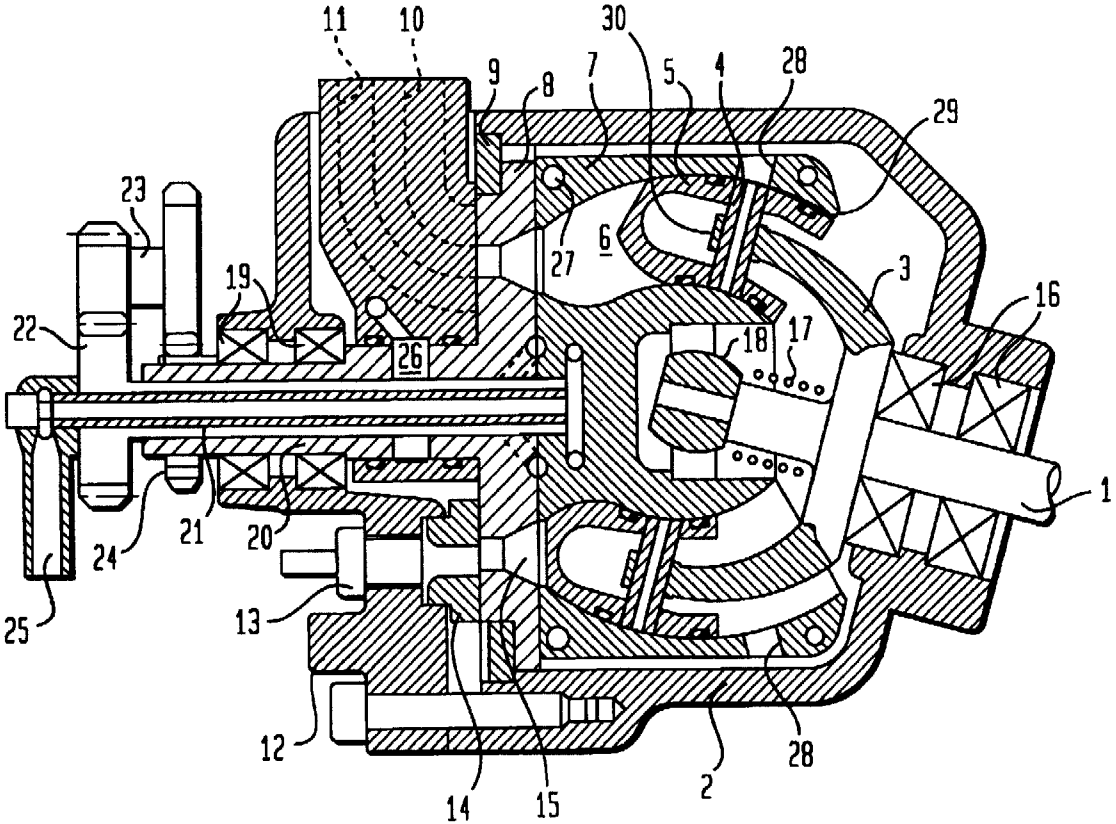
FIG. 1 is a sectional view of an internal combustion engine, with four pistons and a four-stroke cycle, according to one embodiment of the present invention.

In an endothermic engine according to one embodiment of the invention shown in FIG. 1, a driveshaft 1 rotates on bearings 16 in a housing 2. Positioned on each end 3 of the driveshaft 1 is a corresponding curved piston 5 coupled to the end 3 with a wrist pin 4. The piston 5 is driven by the ends 3 to move inside the cylinders, which are machined in the rotating cylinder block 7. A distribution plate 8 rotates on a ring 9 and communicates with an exhaust pipe 10 and an induction pipe 11. A head 12 is equipped with an ignition plug 13 facing the piston 5 in a position of maximum compression, through an anti-wear ring 14 and a combustion chamber 15. The combustion chamber is machined in the distribution plate 8. A spring 17 takes up clearances for sealing between the distribution plate 8 and the cylinder block 7. This spring bears on the spherical bearing 18 for centering the block with the shaft. Guide bearings 19 are mounted in a bore in the head 12 for supporting the tube 20 of the distribution plate 8. Shaft 21 rotates with the cylinder block 7 and, through reduction gearing 22, 23 and 24, drives the tube 20 and thus the distribution plate 8. The distribution plate 8 and the manifolds 10 and 11 define a refrigeration duct 26; the cylinder block defines an analogous refrigeration duct 27. Each cylinder has a radial hole 28 for assembly of the wrist pin 4. The pistons 5 have seal rings 29, and are connected to respective pin bosses 30 of the ends 3 using wrist pins 4. The distribution plate 8 has holes 31, suction ports 32, holes 33 and corresponding exhaust ports 34. In a two stroke embodiment of the engine of the invention, a combustion chamber 35 is formed in a fixed distribution plate 36 (FIG. 3).

Figure 6:
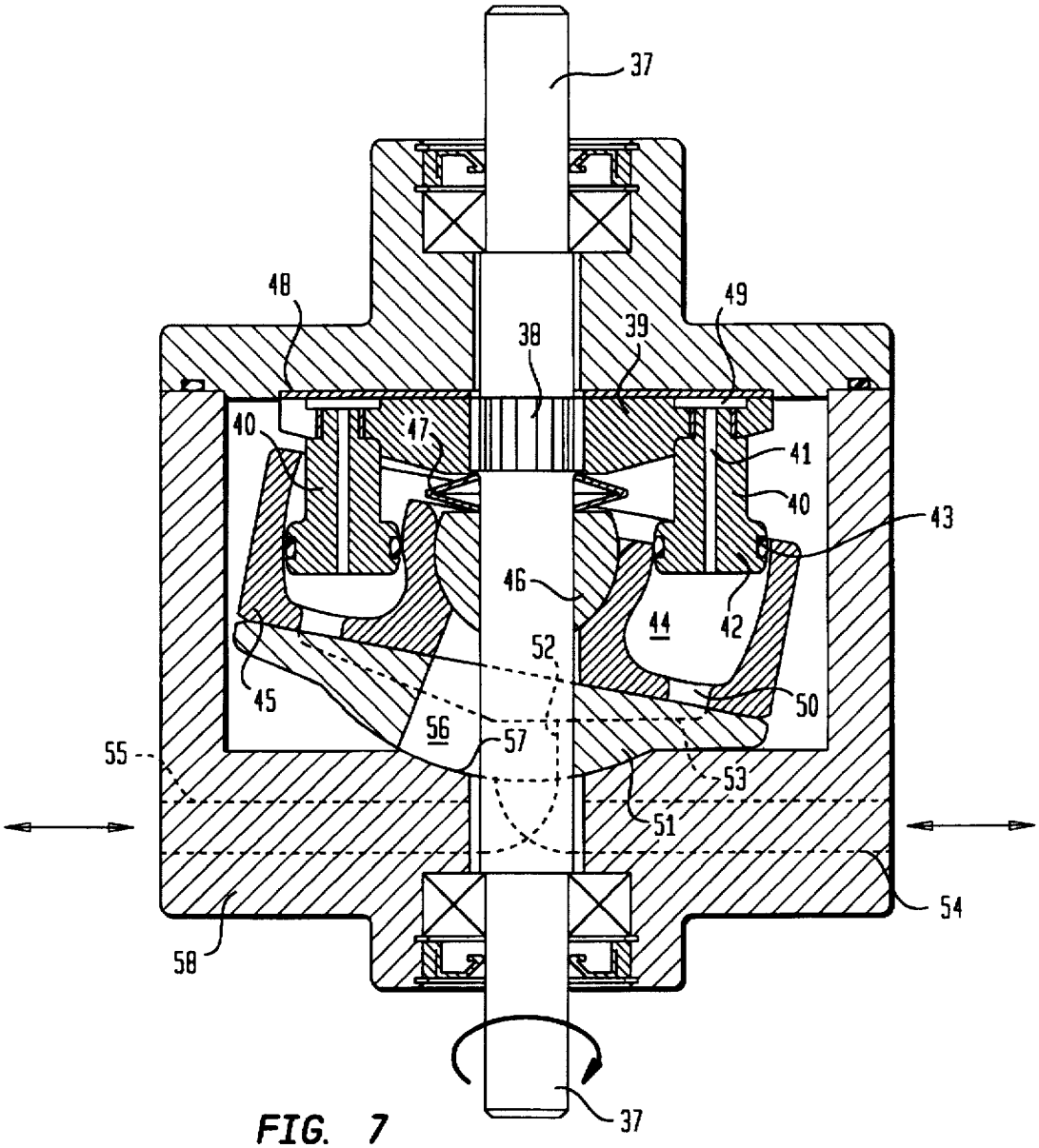
FIG. 6 is a longitudinal sectional view of a pump/engine or compressor for fluids, with variable displacement in both directions, with a rotating and inclinable cylinder block according to one aspect of the invention.
Figure 7:
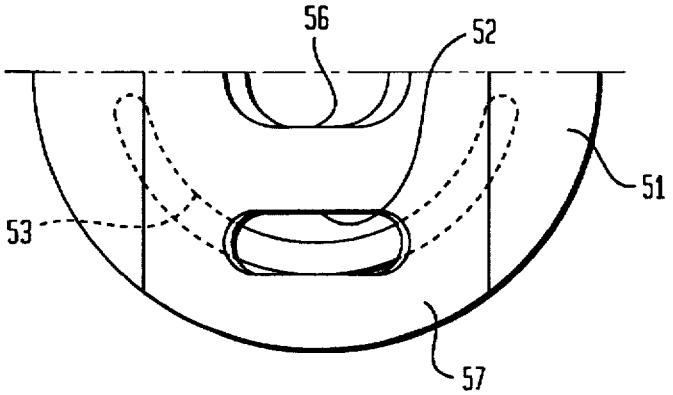
FIG. 7 is a partial plan view of the inclination and fluid distribution plate from the supply side of the pump shown in FIG. 6.
Figure 8:
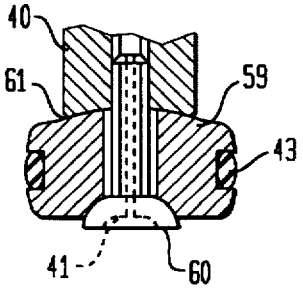
FIG. 8 is a partial sectional view of a piston with oscillating head.

A second embodiment of the invention, in which the volumetric fluid machine is a pump/engine or compressor is shown in FIG. 6. A piston holder plate 39 has a splined profile 38 by which it is mounted on a driveshaft 37. Pistons are screwed onto the holder plate 39 by means of a thread. Each piston comprises a piston shank 40 having a central hole 41 for compensation of axial hydraulic thrust, and a head with spherical profile 42 and a piston ring 43 with external spherical profile. The pistons are driven into the cylinders 44 of the rotating cylinder block 45. The cylinder block 45 is maintained in position with respect to the shaft 37 through a ball joint 46. Compensation springs 47 act on the ball joint 46 and against the holder plate 39, which slides against anti-wear lining 48. Compensation cavities 49 for the compensation of axial hydraulic thrust face the anti-wear lining 48. A hole 50 in the cylinder 45 provides a passageway for the fluid from the cylinder to the distribution cap 51, which has slots 52 and ports 53 on the side facing the cylinder block 45. The slots 52 and ports 53 (FIG. 7) communicate with ducts 54 and 55 in the housing 58 for feeding fluid. The distribution cap 51 is further provided with a slot 56 on its axis for oscillation. The distribution cap is supported in a cylindrical surface in the housing 58. In a variation of this embodiment shown in FIG. 8, the head 59 of the spherical piston can oscillate on the shank 40, sliding on a spherical surface on the screw head 60 and a corresponding spherical surface 61 between the shank 40 and the piston head 59.

Figure 9:
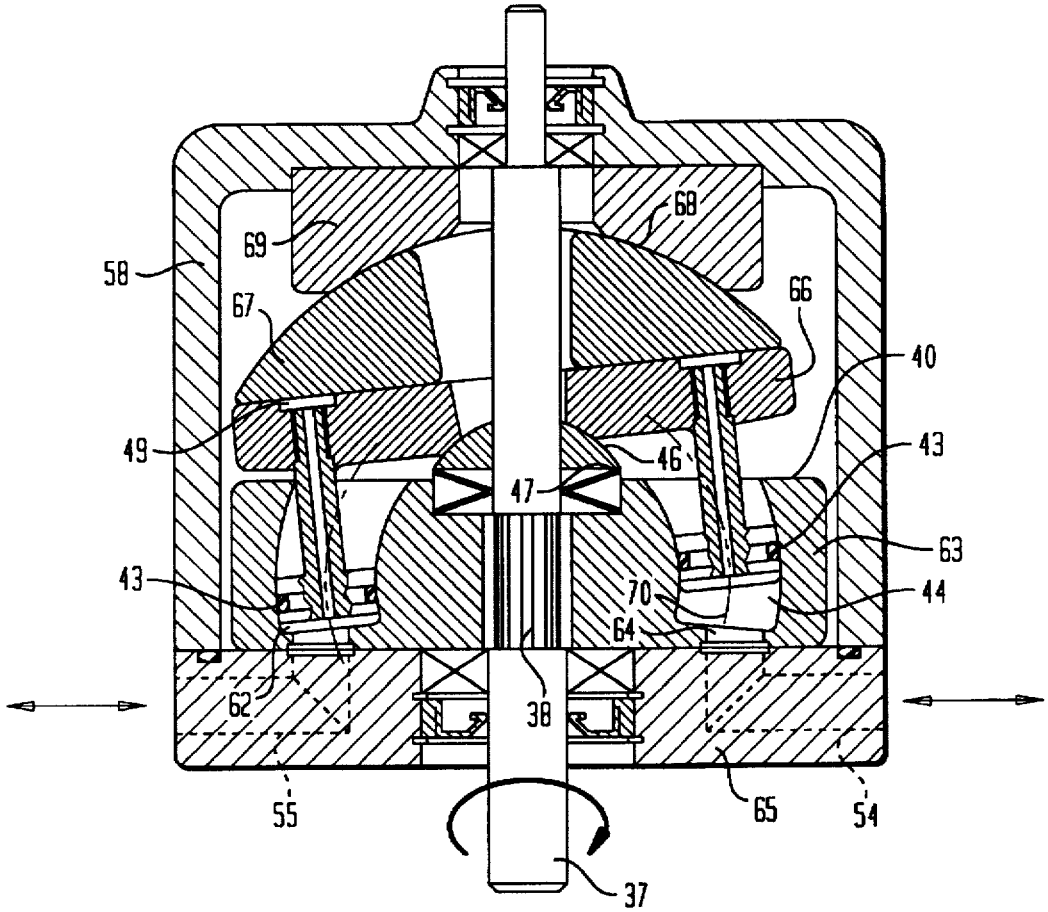
FIG. 9 is a longitudinal sectional view of a pump/engine for fluids with an inclinable piston holder plate, according to one aspect of the invention.
Figure 10:
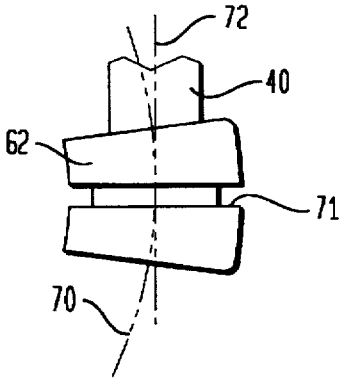
FIG. 10 is a partial side elevational view of a piston for a pump according to one aspect of the invention.
Figure 12:
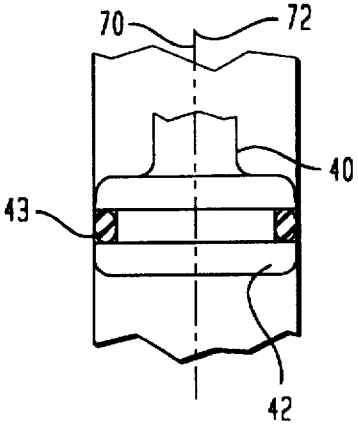
FIG. 12 is a side elevational view of a spherical piston according to one aspect of the invention.

In a third embodiment of the invention shown in FIG. 9, a curved piston 62 is movable in the cylinders of the cylinder block 63. The cylinder block 63 has feed holes 64 facing corresponding feed lines 54 in a cover 65. A piston holder plate 66 is centered on a ball joint 46 and faces a corresponding inclinable cap 67 having a cylindrical surface 68 abutting a block 69 inside the housing 58. The cylinders have a central axis of curvature 70. A piston ring groove 71 (FIG. 10) receives a piston ring 43 (FIG. 12). The piston shank 40 has an axis 72.

Figure 13:
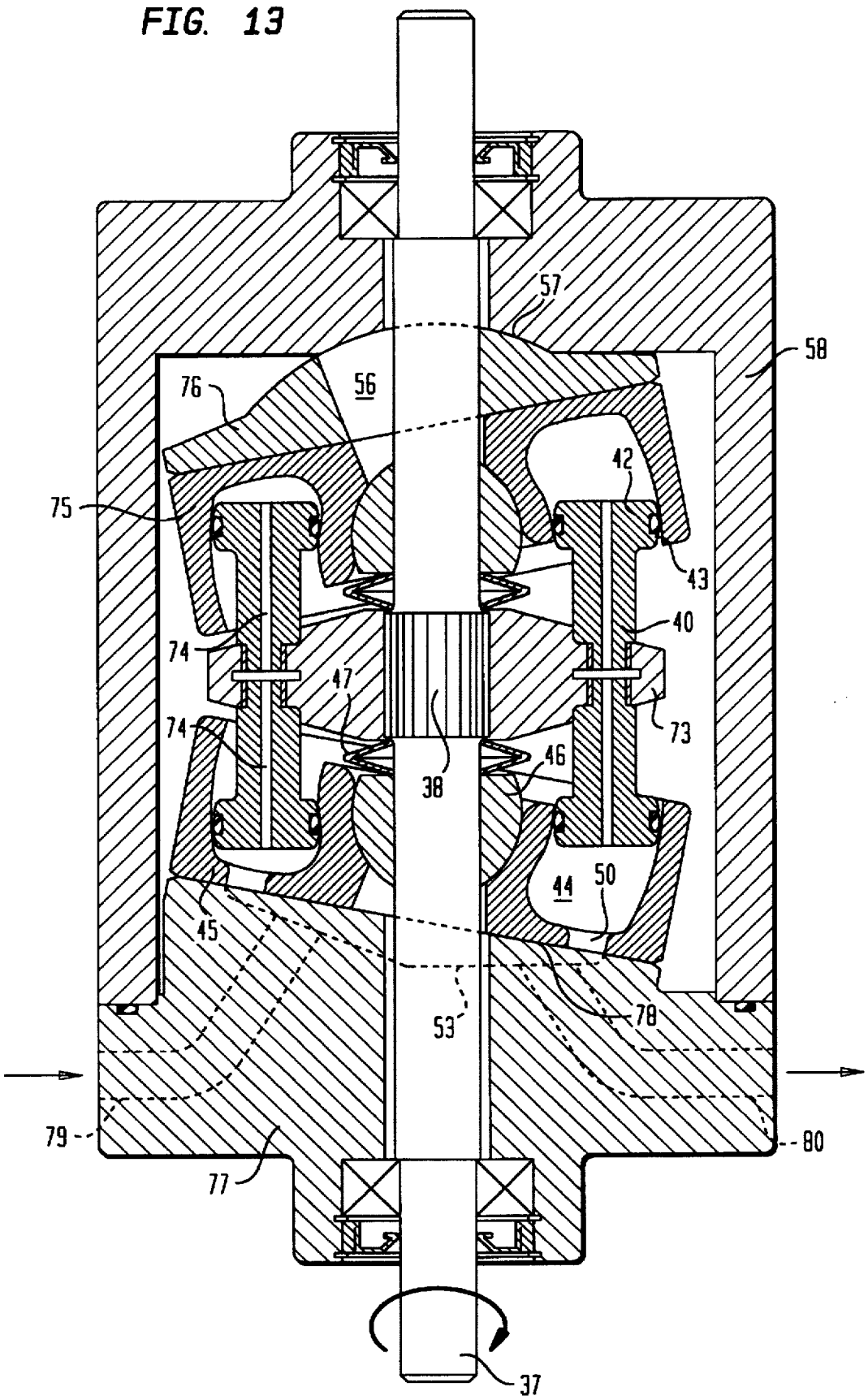
FIG. 13 is a longitudinal sectional view of a pump/engine for fluids without inversion of motion of the fluid, according to one aspect of the invention.

In another embodiment of the invention shown in FIG. 13, a plate 73 having internal splines is splined onto the shaft 37. The plate 73 supports two sets of pistons, which are connected to the plate and which are opposite one another. The pistons have axial holes 74 for fluid communication between the corresponding cylinder chambers. Cylinder block 75 has no feed lines, and rotates at the same speed as cylinder block 45. Cylinder block 75 is biased against the inclinable plate 76, which has no feed slots. A bottom cap 77 guides the fixed displacement cylinder block 45 on an inclined plane 78, which has feed slots 53 and ducts 79, 80.

The functioning of the embodiment of the invention comprising an internal combustion engine (FIG. 1) can be described as follows: as the driveshaft 1 rotates the ends 3, which move pistons 5 in the arched cylinders 6. Displacement results from the rotation of the ends 3 and of the cylinder block 7. The cylinders, which are open on top, communicate with suction ports 31, 32 and exhaust ports 33, 34. The cylinders also communicate with the combustion chamber 15 by rotation of the distribution plate 8. The distribution plate 8 rotates at one-half the speed of the driveshaft 1, such that each cylinder is fed with an air/fuel mixture or with air through the induction port 10, and each cylinder is discharged through exhaust port 11 in the manifold. An ignition plug 13 (or injector in the case of a diesel cycle) initiates combustion in the chamber 15 in the case of a four-stroke engine or in the chamber 35 in the case of a two-stroke engine having the distribution plate fixed in the cylinder head 12. In the case of a four-stroke engine, the distribution plate 8 and tube 20, depending therefrom, rotate at one-half the speed of the cylinder block 7, and are driven through axial driveshaft 21 and timing gears 22, 23 and 24.

During the stroke of the pistons 5 inside the cylinders 6, slight differences in paths are caused in part large inclination angles between the spin axes. Those differences are compensated by oscillation of the pistons on the wrist pins 4 mounted in the hubs 30 of the ends 3. In addition, the wrist pins 4 permit slight radial displacements of the pistons at the intermediate positions of 45, 135, 225 and 315 degrees of rotation.

Coolant is drawn from a radiator through the coolant intake pipe 25 and is conducted into the cylinder block 7 through the hollow shaft 21. The holes 27 in the cylinder block receive the coolant by means of radial ducts (not shown) that are situated between the cylinders. The coolant is therefore centrifugated by rotation of the cylinder block and fills the internal volume of the housing 2. The heated coolant flows out of the housing into return tubes (no shown) toward the radiator. The coolant passes through the annular space between the tube 20 and the coaxial shaft 21, cooling the central part of the distribution plate 8. The coolant also cools the manifolds as it passes through ducts therein.

The pump/engine or compressor embodiment of the invention, shown in FIG. 6, functions as follows: pressurized fluid enters the device through ducts 54, 55 in the housing 58. The fluid enters the distribution cap 51 through slots 52, and flows through ports 53 into holes 50 in the cylinder block 45, entering the cylinders 44. Hydraulic forces on the surface of the piston head 42 are distributed with respect to the position of the piston ring 43; i.e., the forces are exactly axial to the piston shank 40 without radial components driving the piston against the cylinder walls. Driveshaft 37 rotates the piston holder plate 39 through splined fitting 38. Compensation cavities 49, which are held at the same pressure as the cylinders 44 through the compensation hole 41, balance the axial hydraulic thrust on the piston holder plate 39 and on the pistons. Belleville washers 47 take up end clearances between the cylinder block 45, the distribution cap 51 and the housing 58. The preloading force of the Belleville washers is considerably larger than the force generated during the suction at atmospheric pressure.

Variation of displacement, a major element of versatility during use, is possible by adjusting the inclination of the distribution cap 51 by sliding on the cylindrical surface 57. In the embodiment wherein an oscillating piston head 59 is employed, the system remains balanced at increased angles between the axes of rotation of the pistons and of the cylinder block because the center of rotation of the piston head as it oscillates on the screw 60 is located within the fluid in the cylinder. In contrast, the equivalent center of rotation of a standard piston is through the wrist pin, which is located well behind the surface of the piston in contact with the fluid.

Figure 11:
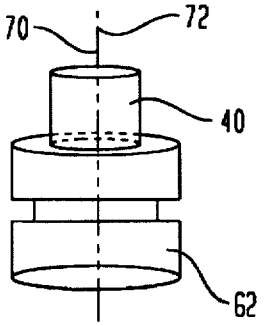
FIG. 11 is a partial side elevational view of the piston of FIG. 10 rotated ninety degrees.

The operation of the third embodiment of the invention, comprising a pump/engine or compressor for fluids as shown in FIG. 9, is as follows: unlike the other embodiments, the driveshaft 37 is splined to the cylinder block 63, which drives the piston heads 62. This arrangement generates a radial component of force on the piston head 62, causing wear on the cylinder walls. A curved piston head 62 (see FIGS. 10 and 11) provides improved results in designs using a large inclination between the axes of rotation; this is so, despite an increased difficulty in manufacture. Displacement may be varied in this embodiment by inclining the cap 67 on cylindrical surface 68.

Figure 14:
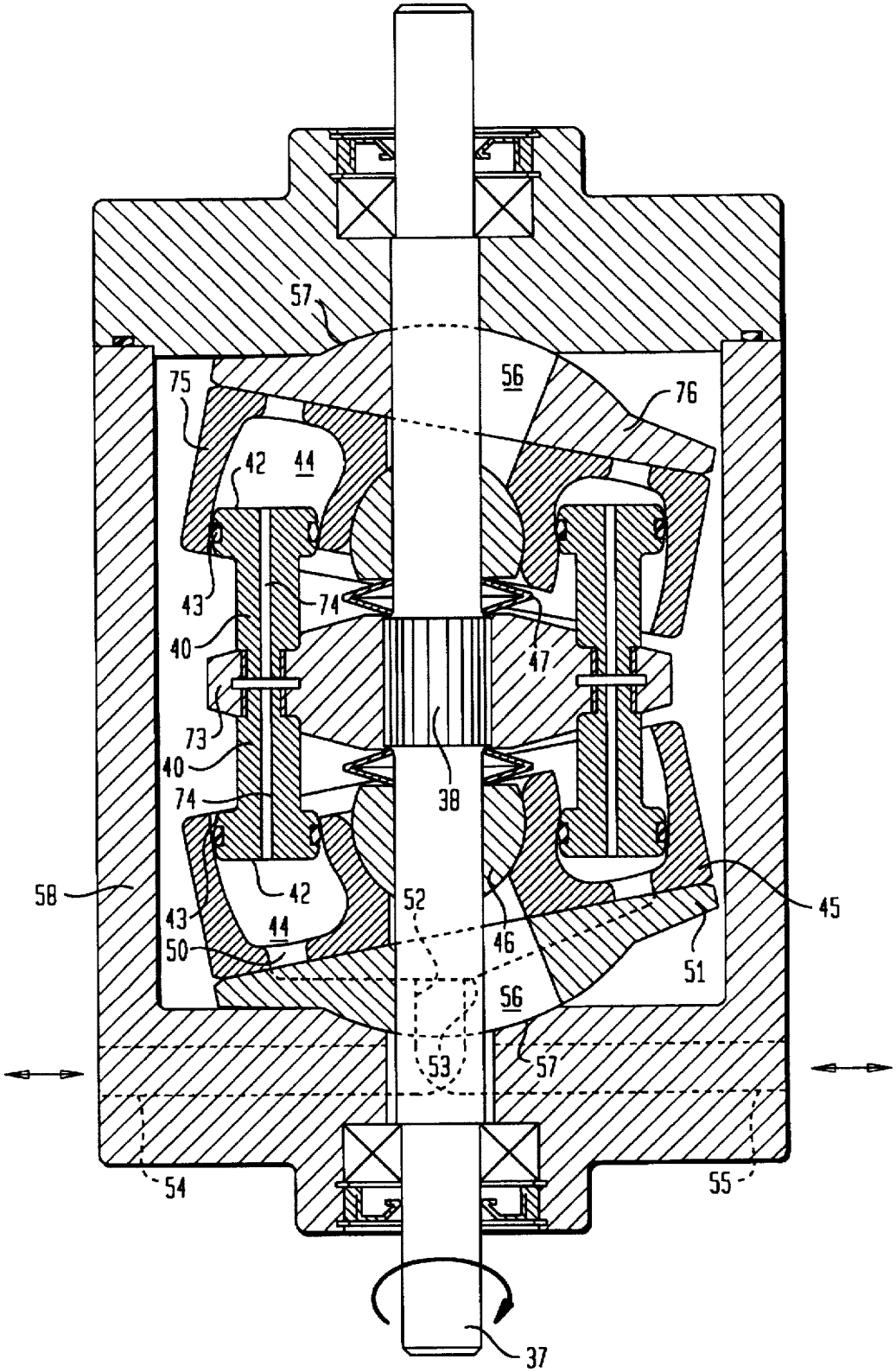
FIG. 14 is a longitudinal section view of a pump/engine for fluids with both pumping mechanisms having variable displacement.

The embodiments shown in FIGS. 13 and 14 are pumps/engines or compressors for fluids. The embodiment of FIG. 13 is a pump/engine having one set of pistons with variable displacement and the other set of pistons with fixed displacement. The embodiment of FIG. 13 does not permit the inversion of the direction of the fluid flow. In the embodiment of FIG. 14, both sets of pistons have variable displacement and the direction of fluid flow may be inverted, as shown by the arrows next to feed lines 54, 55. The caps 51 and/or 76 are inclined using well-known mechanisms controlled externally. In both the embodiments of FIG. 13 and FIG. 14, the piston holder plate 73 is splined or keyed on the driveshaft 37. Axial thrust on the piston holder by the opposing cylinders 44 is balanced through the use of axial holes 74 in the pistons; as a result, less work is done by the fluid in passing through the machine.

The embodiment shown in FIGS. 13 and 14 can function as a pump/compressor for a complete range of angles of the cap 51 and/or 76. When configured as an engine, however, because displacement must be greater than zero, the angle of the cap must not be unduly reduced. Moreover, because the elimination of flow between the two sets of pistons in the double embodiments shown in FIGS. 13 and 14 reduces efficiency, displacement of the upper set of pistons must not be reduced to zero. Further, the cylinder blocks 45, 75 must not be inclined in a phase opposite that shown in FIGS. 13 and 14, i.e., inclined in the same direction. Instead, the caps should be inclined as shown, or in the case of FIG. 14 with both inclinations reversed where the fluid flow is reversed.

As these and other variations and combinations of the features discussed above can be utilized without departing from the present invention as described by the claims, the foregoing description of the preferred embodiments should be taken by way of illustration rather than by way of limitation of the claimed invention.

For example, the pump/engine or compressors of FIGS. 6 and 9 may be of fixed displacement. A pump and an engine may be paired through the balancing cavities 49 or the feed ports 64, by interposing a fixed distributor to the housing, producing a compact hydrostatic drive. Such a drive would have reduced overall dimensions and weight, and would run at high speed.

In an additional example, the pistons may be rigidly fixed to the housing, and the cylinder block may be oscillated by means of an axial or radial cam, connected to the driveshaft. The resulting pump/engine or compressor would have almost no moving parts except for the cam. Such an arrangement would be especially suited for pumps or engines for liquids.

On the analogy of variable displacement pumps/engines or compressors, an endothermic engine having the piston configuration shown as elements 5, 42, 59 or 62 and the rotating cylinder block 7, would be capable of reducing displacement, thereby facilitating the adjustment of the air/fuel mixture without the complex artifices presently employed for that adjustment, and achieving advantageous efficiencies at lean mixtures.

I claim:

1. A volumetric fluid machine, comprising:

a housing;

a driveshaft having a first axis;

a plurality of pistons connected to said driveshaft and rotatable about said first axis, said pistons projecting from said driveshaft;

a cylinder block having a plurality of cylinders, said cylinder block being rotatable within the housing about a rotation center situated on said first axis;

a distribution plate having at least one passageway for communication with said plurality of cylinders;

said cylinders having an arched-shaped configuration with a concavity facing said rotation center, and with a center of curvature corresponding to said rotation center;

said cylinder block being synchronically driven by said pistons on a second axis, intersecting said first axis on said rotation center and being in slideable contact with a sliding surface having an axis corresponding to said second axis to provide a reciprocating movement of said pistons within said cylinders;

spherical means on said driveshaft for centering said cylinder block; and biasing means for biasing said cylinder block against said sliding surface.

2. The volumetric fluid machine according to claim 1, wherein means for varying an inclination between said second axis of the block and said first axis of the pistons provides variable displacement.

3. The volumetric fluid machine of claim 2, further comprising a plate having a rear substantially cylindrical surface, whereby an axis of rotation of said plate passes through the point of intersection between said first axis of rotation of said pistons and said second axis of said block.

4. The volumetric fluid machine of claim 2, wherein said drive shaft is rotatably mounted to said housing on first and second sides of said pistons.

5. The volumetric fluid machine of claim 2, wherein said means for varying the inclination of said second axis to said first axis comprises means for varying an inclination of said sliding surface.

6. The volumetric fluid machine of claim 1, wherein said pistons are movably connected to said drive shaft without interposition of connecting rods.

7. The volumetric fluid machine of claim 1, wherein said pistons are movably connected to a said holding plate without interposition of connecting rods.

8. The volumetric machine of claim 1, wherein each said piston is formed with a substantially spherical head having seal rings, each said seal ring formed with a substantially spherical surface, each said substantially spherical surface is located in said piston head so as to contact a wall of the corresponding cylinder radially with respect to a longitudinal axis of said cylinder.

9. The volumetric fluid machine according to claim 1, wherein said distribution plate is situated adjacent to said block, said distribution plate having at least one communication port for communication to said cylinders, at least one outlet port and at least one combustion chamber, wherein said at least one communication port, said at least one outlet port and said at least one combustion chamber rotate with respect to said housing.

10. The volumetric fluid machine of claim 9, further comprising a single auxiliary cooling and lubricating circuit.

11. The volumetric fluid machine according to claim 10, wherein said block forms a movable part of a pump for said cooling and lubricating circuit.

12. The volumetric fluid machine of claim 1, wherein said drive shaft is rotatably mounted to said housing on first and second sides of said pistons.

13. The volumetric fluid machine of claim 1, wherein said second axis is inclinable.

14. The volumetric fluid machine of claim 2, wherein said second axis is inclinable.

15. The volumetric fluid machine of claim 1 wherein said pistons project from a holding plate attached to said drive-shaft.

16. The volumetric fluid machine of claim 15, wherein said pistons are rigidly connected to said holding plate without interposition of connecting rods.

17. The volumetric fluid machine of claim 1 wherein said distribution plate comprises said sliding surface.

* * * * *

UNITED STATES PATENT AND TRADEMARK OFFICE

CERTIFICATE OF CORRECTION

PATENT NO. : 5,636,561

DATED : June 10, 1997

INVENTOR(S) : Pecorari

It is certified that error appears in the above-identified patent and that said Letters Patent is hereby corrected as shown below:

Column 9, line 23, delete "a".

Signed and Sealed this

Nineteenth Day of August, 1997

*Attest:*

*Attesting Officer*

Bruce Lehman

BRUCE LEHMAN

*Commissioner of Patents and Trademarks*